United States Patent [19]

York

[11] Patent Number: 4,960,303

[45] Date of Patent: Oct. 2, 1990

[54] FOLDING TABLE AND SEAT ASSEMBLY

[76] Inventor: Melvin B. York, 2941 Seymour Lake Rd., Apt. B1, Oxford, Mich. 48051

[21] Appl. No.: 408,893

[22] Filed: Sep. 18, 1989

[51] Int. Cl.[5] ..... A47B 39/00

[52] U.S. Cl. ..... 297/159; 297/139

[58] Field of Search ..... 297/159, 157, 14, 139; 248/188.6, 188.8; 108/18, 19, 36, 112, 113, 114, 131, 132

[56] References Cited

U.S. PATENT DOCUMENTS

| | | | |
|---|---|---|---|
| 36,781 | 10/1862 | Hunter | 108/19 X |
| 732,585 | 6/1903 | Reinhardt | 108/19 |
| 1,407,463 | 2/1922 | Fetterman . | |
| 1,594,572 | 8/1926 | Soltesz | 297/139 |
| 1,956,483 | 4/1934 | Alpers . | |
| 2,436,730 | 2/1948 | Repke | 297/139 |
| 2,502,502 | 4/1950 | Bennett . | |
| 2,613,728 | 10/1952 | Loibl, Sr. | 297/139 |
| 2,766,812 | 10/1956 | Schrader | 297/159 X |
| 2,780,506 | 2/1957 | Howe | 297/159 X |
| 2,991,829 | 6/1961 | Post | 297/139 |
| 3,049,387 | 8/1962 | Schlegel | 108/112 |
| 3,731,971 | 5/1973 | Sjogren | 297/159 |
| 4,052,100 | 10/1977 | Nikitits et al. | 297/159 |
| 4,111,482 | 9/1978 | Jones | 297/159 |

FOREIGN PATENT DOCUMENTS

| | | | |
|---|---|---|---|
| 8001508 | 7/1980 | PCT Int'l Appl. | 248/188.6 |

*Primary Examiner*—Jose V. Chen

*Attorney, Agent, or Firm*—Charles W. Chandler

[57] ABSTRACT

A collapsible table top and seat assembly including a table top with four collapsible legs, disposed beneath the table top. Each collapsible leg comprises an upper leg member and a lower leg member. When the upper and lower leg members are folded and disposed at right angles to the table top, the four leg assemblies support the table top at the height of a coffee table. When the lower leg members are unfolded and locked with respect to the upper leg members, the four leg assemblies support the table top at a conventional height. A collapsible seat assembly is mounted on each leg assembly, and arranged so that selected seat assemblies can be unfolded to support a user. Each of the four leg assemblies and seat assemblies can be collapsed to a position beneath the table so as to require only a relatively thin storage area.

2 Claims, 3 Drawing Sheets

FOLDING TABLE AND SEAT ASSEMBLY

BACKGROUND OF THE INVENTION

This invention is related to collapsible, combination table top and seat assemblies, and more particularly to such a combination in which the table top can be supported at a relatively low height to function as a coffee table, or at a raised height, depending upon the position of the table legs. A seat assembly is mounted on each table leg. Selected seat assemblies may be opened or closed depending on the number of occupants using the table.

Collapsible or folding table top and seat assemblies are particularly useful when the assembly is stored in either a relatively compact area or is to be transported to a picnic or beach area. Such seat assemblies are also useful in public facilities when a room is to be cleared of tables or when only a selected number of tables must be set up. Examples of such prior art are to be found in U.S. Pat. No. 4,111,482, which issued to William C. Jones, Sept. 5, 1978; U.S. Pat. No. 4,052,100 which issued Edwin Nikitits and Jean Guy Demers, Oct. 4, 1977; U.S. Pat. No. 2,502,502 which issued to F. J. Bennett, Apr. 4, 1950; U.S. Pat. No. 1,956,483 which issued to Henry Alpers, Apr. 24, 1934; and U.S. Pat. No. 1,407,463 which issued to C. R. Fetterman, Feb. 21, 1922.

SUMMARY OF THE INVENTION

The preferred embodiment of the invention comprises a collapsible table and seat assembly in which a circular table is supported by four leg assemblies. Each leg assembly includes a pair of collapsible legs including an upper leg hingedly locked to the lower side of the table top, and a lower leg hingedly locked to the lower end of the upper leg. Each leg assembly is movable between a fully collapsed condition when the table assembly is to be stored, a partially-opened position in which the four upper legs support the table top in a low position, and a fully open position in which the upper and lower leg members support the table top at a conventional table height.

A seat assembly is hingedly connected to each of the leg assemblies and comprises a seat member which may be supported in a horizontal position. Each seat has a leg assembly which may be collapsed with the seat when the seat assembly is not being used. In its collapsed position, the seat assembly is disposed adjacent the upper leg member to which it is connected.

In another embodiment of the invention, the table top can be folded in two sections such that two leg assemblies are supported on one side of the folded table top and the other leg assemblies are supported on the opposite side of the folded table top assembly.

The preferred combination table top and seat assembly can be stored in a relatively, thin, compact area; can be easily opened so that either all or only selected legs are disposed to support the table top in either its lower position to function as a coffee table, or a conventional table height.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views in which.

DESCRIPTION OF THE PREFERRED EMBODIMENT

Figure 1:
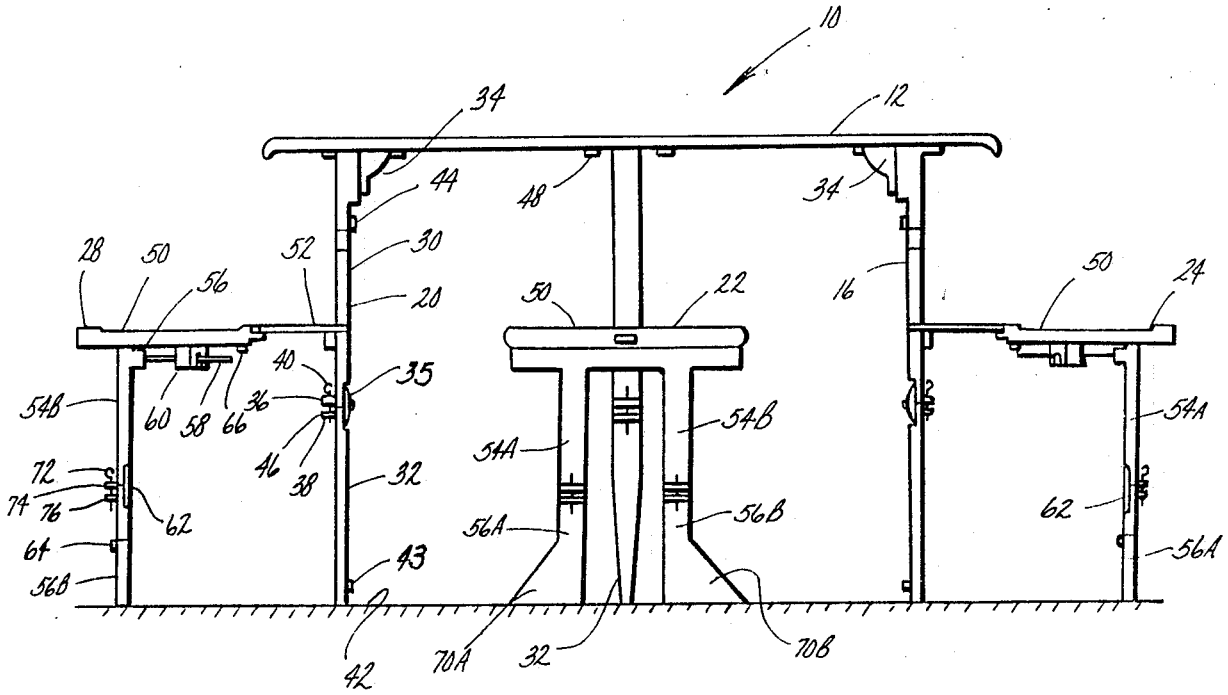
FIG. 1 is an elevational view of a preferred table top and seat assembly in its fully-opened position.
Figure 5:
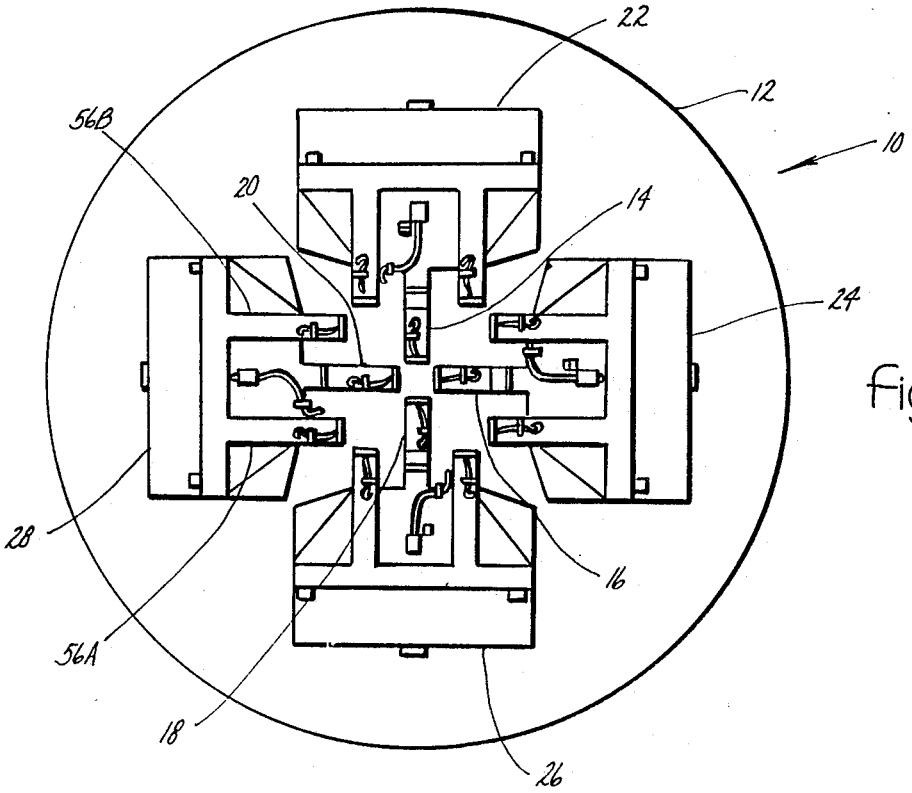
FIG. 5 is a bottom view of the table top showing the seats in their fully collapsed position.

Referring to the drawings, FIGS. 1 and 5 illustrate a preferred table top assembly 10 comprising a circular table top 2. Four leg assemblies 14, 16, 18 and 20 are connected to the lower surface of the table top, and four seat assemblies 22, 24, 6 and 28 are connected to leg assemblies 14, 16, 18 and 20, respectively.

In this embodiment of the invention, each of the leg assemblies are similar to one another, so that a description of one seat assembly and one leg assembly applies to the other seat and leg assemblies except for their respective location beneath the table top.

Figure 2:
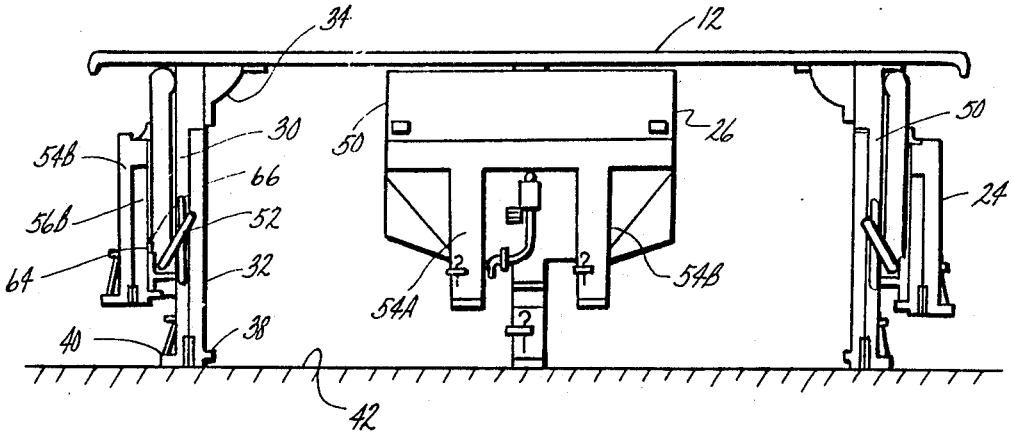
FIG. 2 is an elevational view showing the leg assemblies partially folded so that the table top is supported in its lower position.

Referring to FIGS. 1 and 2, typical leg assembly 20 comprises an upper leg member 30 and a lower leg member 32. The upper leg member is movable between an open position at right angles to the bottom of the table top, and a closed position, illustrated in FIG. 3, in which the upper leg member is disposed parallel and adjacent to the table top. A locking hinge 34, of the type that snaps to an open position, illustrated in FIG. 1, attaches the upper end of the upper leg member to the table top.

A conventional hinge means 35 connects the lower end of the upper leg member to the upper end of the lower leg member 32. The upper leg member has an eye 36 and the lower leg member has an eye 38. Locking pin 40 is received through the two eyes to lock the upper leg member and the lower leg member in an upright position, as illustrated in FIG. 1.

When each of the seat assemblies are fully collapsed, and each lower leg member is folded, as illustrated in FIG. 2, the lower ends of the four upper leg members are adapted to engage floor 42 to support table top 12 in a lower position in which it is adapted to function as a coffee table or the like. When pin 40 is removed from eyes 36 and 38, lower leg member 32 can be folded to a parallel position with respect to upper leg member 30. A strip of a Velcro fastener 43 on the lower leg member is adapted to mate with a cooperating strip of a releasable Velcro fastener material 44 on the upper leg member to connect the two leg members together in a parallel position.

Figure 3:
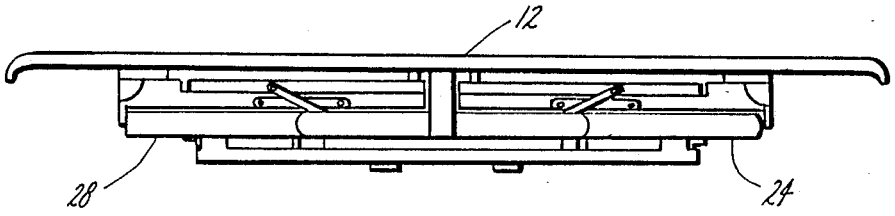
FIG. 3 is a view of the preferred table top and seat assembly in its fully collapsed position.
Figure 4:
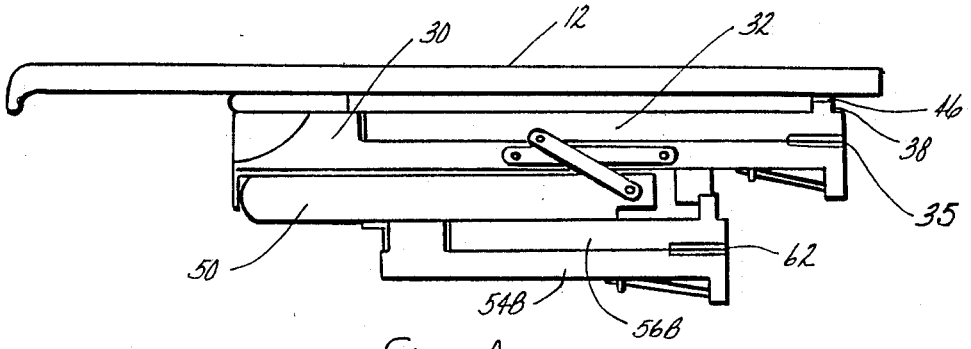
FIG. 4 is an enlarged view of a seat assembly in its seats in their fully collapsed position.

Eye 38 has a strip of Velcro fastener material 46 engagable with a complementary strip of Velcro fastener material 48, mounted on the bottom surface of the table top so that the upper leg can be retained in its folded position, as illustrated in FIGS. 3 and 4.

Referring to FIGS. 1 and 2, typical seat assembly 28 includes a seat panel 50, connected by a folding hinge means 52, which is pivotally connected to upper leg 30. The seat is supported by upper seat legs 54A and 54B and lower seat legs 56A and 56B. Upper seat legs 54A and 54B are connected by hinge 56 to the lower seat legs. Locking pin 58, slideably mounted on support 60, is adapted to engage the upper seat legs to lock them in a upright position.

Hinge 62 connects the lower leg member to the upper leg member so that the lower leg member can be folded, as illustrated in FIGS. 2 and 3 to a position in which the lower leg member is disposed parallel and inside of the upper leg member and both leg members folded beneath the table top. In this position, the lower seat legs 56A and 56B are pivoted toward the upper seat legs and all the seat legs are folded toward the bottom of the seat. All of the lower seat legs have a strip of releasable fastener material 64 adapted to engage a complementary strip of fastener material 66 attached to the bottom of the seat panel.

Referring to FIG. 1, the lower ends of seat legs 56A and 56B are tapered to provide a laterally extending pair of feet 70A and 70B, to provide stability for the seat when a user occupies it.

In use, FIG. 3 illustrates the table and chair assembly in its fully collapsed position with all four seat assemblies collapsed and leg assemblies collapsed. The user can exercise any of several options. FIG. 2 illustrates one option in which the upper leg members are unfolded with the seat assemblies and the lower leg assemblies. The lower end of the upper leg members engage the floor to support the table top at a relatively low height.

The user can raise the table top by lowering lower leg members 32 and locking them into position with locking pins 40. The user can then unfold from 1–4 seat assemblies depending upon the number of occupants at the table, by unfolding each seat 50 to a horizontal position, and then unfolding legs 54A and 54B, and 56A and 56B, and locking them with locking pins 72, which are received in eyes 74 and 76 of the seat legs.

Hinge 62 and locking pin 72 can be replaced by a type of commercially available hinge that locks in the fully open position.

Figure 6:
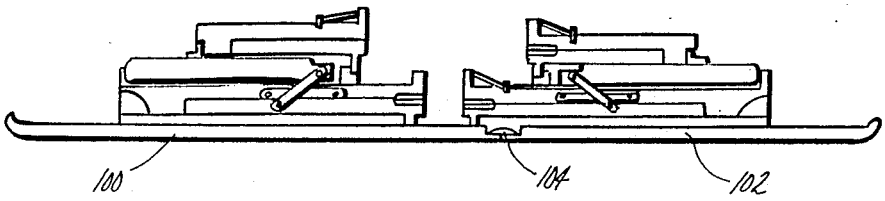
FIG. 6 is a view of another embodiment of the invention in which the table comprises a pair of hinged sections.
Figure 7:
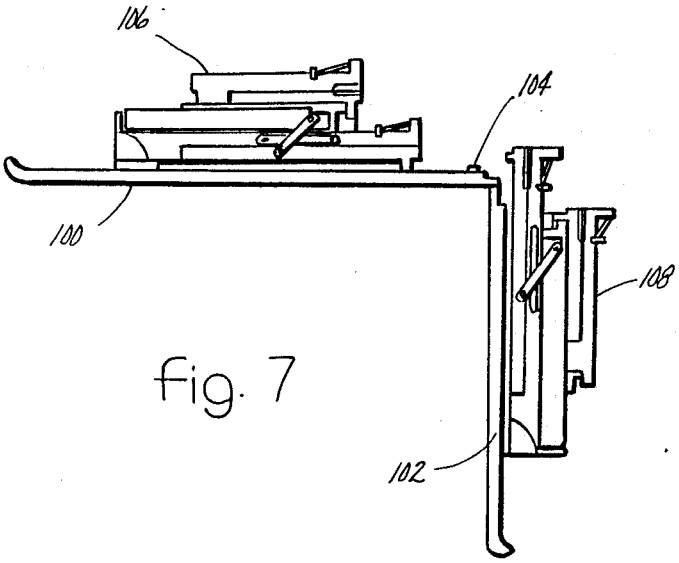
FIG. 7 is a view similar to FIG. 6, in which the two table top section partially folded.
Figure 8:
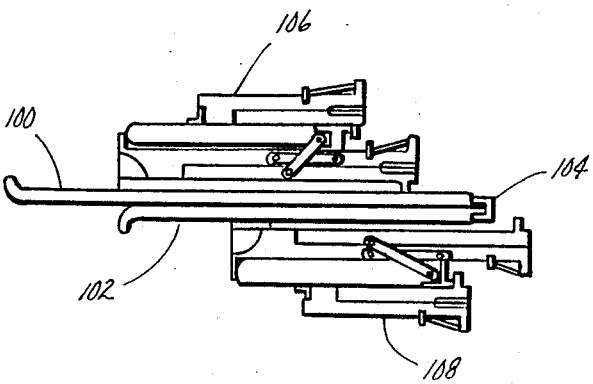
FIG. 8 is a view similar to FIG. 6 in which the two table top sections are fully folded.

FIGS. 6–8 illustrate another embodiment of the invention. In this embodiment a folding top is formed of a pair of table top sections 100 and 102 connected by hinge means 104 so that section 102 can be folded closely adjacent section 100 as illustrated in FIG. 8. Section 102 is smaller than section 104. Seat assembly 106 is mounted on table top section 100, and seat assembly 108 is mounted on table top section. 102. The seat assemblies are identical, as illustrated in FIG. 1 and preferrably mounted in pairs. In this case, the seat assemblies are mounted on opposite sides of the folded table top, as illustrated in FIG. 8. This has utility when a more compact, but thicker table assembly is desired when the assembly is disposed in its fully collapsed position.

Having described my invention, I claim:

1. A folding table and seat assembly comprising:

a planar table top having a lower side;

a plurality of leg means connected to the lower side of the table top, each of the leg means including an upper leg member and a lower leg member, each upper leg member having an upper end and a lower end, and each lower leg member having an upper end and a lower end;

first hinge means connecting the upper end of the upper leg member to the lower side of the table top such that the upper leg member is movable between a closed position substantially parallel to the lower side of the table top, and an open position in which the upper leg member is disposed generally normal to the table top, so as to cooperate with the other upper leg members to support the table top in a horizontal position at such times as the lower end of the upper leg members are disposed on a supporting surface;

second hinge means connecting the upper end of the lower leg members to the lower end of the upper leg members such that when each upper leg member is in said open position, the lower leg member is movable between a first position in which it is disposed closely adjacent and parallel to the upper leg member, permitting the lower end of the upper leg member to engage the supporting surface, and a second position in which the lower leg member is disposed beneath the upper leg member to support same in a raised position;

seat means connected to at least one of the leg means, the seat means including a seat member and a seat leg member;

third hinge means for connecting the seat means to the leg means such that the seat means is movable between a closed position in which it is disposed adjacent to and parallel to an upper leg member, and an open position in which the seat means is disposed generally at right angles to the leg means;

fourth hinge means connecting the seat leg member to the seat member such that the seat leg member is movable between a closed position in which it is disposed beneath and parallel to the seat member, and an open position in which the seat leg member is disposed beneath the seat member to cooperate with the leg means in supporting the seat member in a generally horizontal position; and each of said leg means and each of said seat means being movable to a fully collapsed position in which the seat member is disposed on one side of the upper leg member and the lower leg member is disposed on the opposite side of the upper leg member, and the seat leg member, the upper leg member and the lower leg member are all disposed parallel to and adjacent the lower side of the table top.

2. A folding table and seat assembly comprising:

a planar table top having a lower side;

a plurality of leg means connected to the lower side of the table top, each of the leg means including an upper leg member and a lower leg member, each upper leg member having an upper and lower end, and each lower leg member having an upper end and a lower end;

first hinge means connecting the upper end of the upper leg member to the lower side of the table top such that the upper leg member is movable between a closed position substantially parallel to the lower side of the table top, and an open position in which the upper leg member is disposed generally normal to the table top, so as to cooperate with the other upper leg members to support the table top in a horizontal position at such times as the lower end of the upper leg members are disposed on a supporting surface;

second hinge means connecting the upper end of the lower leg members to the lower end of the upper leg members such that when each upper leg member is in said open position, the lower leg member is movable between a first position in which it is disposed closely adjacent and parallel to the upper leg member, permitting the lower end of the upper leg member to engage the supporting surface, and a second position in which the lower leg member is disposed beneath the upper leg member to support same in a raised position;

seat means connected to at least one of the leg means, the seat means including a seat member and a seat leg member;

third hinge means for connecting the seat means to the leg means such that the seat means is movable between a closed position in which it is disposed adjacent to and parallel to an upper leg member, and an open position in which the seat means is disposed generally at right angles to the leg means;

fourth hinge means connecting the seat leg member to the seat member such that the seat leg member is movable between a closed position in which it is disposed beneath and parallel to the seat member, and an open position in which the seat leg member is disposed beneath the seat member to cooperate with the leg means in supporting the seat member in a generally horizontal position; and in which the seat means comprises a pair of seat assemblies, and the table top comprises a pair of table sections, and hinge means connecting the two sections together such that they are foldable to a position in which one of the pair of seat assemblies is disposed on one side of the folded table top, and the other of the pair of seat assemblies is disposed on the opposite side of the folded table top.

* * * * *